US007549547B2

(12) United States Patent
Herr et al.

(10) Patent No.: US 7,549,547 B2
(45) Date of Patent: Jun. 23, 2009

(54) COMPOSITE TWO-PIECE TAMPER-EVIDENT CLOSURE WITH A SEAL-DELAY-RELEASE FEATURE AND A METHOD THEREFOR

(75) Inventors: James E. Herr, Lititz, PA (US); Mark R. Fricke, Newburgh, IN (US)

(73) Assignee: Berry Plastics Corporation, Evansville, IN (US)

( * ) Notice: Subject to any disclaimer, the term of this patent is extended or adjusted under 35 U.S.C. 154(b) by 330 days.

(21) Appl. No.: 11/349,365

(22) Filed: Feb. 6, 2006

(65) Prior Publication Data

US 2007/0017891 A1 Jan. 25, 2007

Related U.S. Application Data

(63) Continuation of application No. 11/146,654, filed on Jun. 6, 2005, now abandoned.

(51) Int. Cl.
*B65D 53/04* (2006.01)
*B65D 41/34* (2006.01)

(52) U.S. Cl. ..... 215/351; 215/252; 215/220

(58) Field of Classification Search ..... 215/220, 215/252, 349, 350, 351
See application file for complete search history.

(56) References Cited

U.S. PATENT DOCUMENTS

| | | | | |
|---|---|---|---|---|
| 2,054,032 | A * | 9/1936 | Conner et al. | 215/252 |
| 2,409,846 | A * | 10/1946 | Greene | 215/253 |
| 2,560,793 | A * | 7/1951 | Greene | 215/252 |
| 3,189,209 | A * | 6/1965 | Owens | 215/329 |
| 3,973,690 | A * | 8/1976 | Schneider | 215/329 |
| RE33,265 | E * | 7/1990 | Gregory et al. | 215/252 |
| 5,078,290 | A | 1/1992 | Ochs | |
| 5,240,131 | A | 8/1993 | Keller | |
| 5,280,842 | A | 1/1994 | Koo | |
| 5,316,161 | A | 5/1994 | Gargione | |
| 5,346,082 | A | 9/1994 | Ochs et al. | |
| 5,433,329 | A | 7/1995 | Weinstein | |
| 5,445,283 | A | 8/1995 | Krautkramer | |
| 5,611,443 | A | 3/1997 | King | |
| 5,732,836 | A | 3/1998 | Barker et al. | |
| 5,743,419 | A | 4/1998 | King | |
| 5,769,252 | A | 6/1998 | Volpe | |
| 5,839,592 | A | 11/1998 | Hayes | |
| 5,862,928 | A | 1/1999 | Breuer et al. | |

(Continued)

FOREIGN PATENT DOCUMENTS

EP 120644 A2 * 10/1984

OTHER PUBLICATIONS

Definition of the word "opening", from Dictionary.com (http://dictionary.reference.com/browse/opening), Apr. 17, 2008.*

(Continued)

*Primary Examiner*—Anthony D Stashick
*Assistant Examiner*—James N Smalley
(74) *Attorney, Agent, or Firm*—Barnes & Thornburg LLP

(57) ABSTRACT

A package includes a container, a seal, and a closure. The container is formed to include an interior region and an opening into the interior region. The seal is coupled to the container to close the opening. The closure is coupled to the container to cover the seal.

17 Claims, 3 Drawing Sheets

U.S. PATENT DOCUMENTS 5,884,788 A * 3/1999 Wilde ..... 215/230
5,984,124 A 11/1999 Takano
6,206,216 B1 3/2001 Stalions
6,382,444 B1 5/2002 Nyman
6,761,275 B1 * 7/2004 McBride et al. ..... 215/349

OTHER PUBLICATIONS

Definition of "plane", from Mathwords.com (http://www.mathwords.com), Apr. 17, 2008.*

* cited by examiner

COMPOSITE TWO-PIECE TAMPER-EVIDENT CLOSURE WITH A SEAL-DELAY-RELEASE FEATURE AND A METHOD THEREFOR

CROSS-REFERENCE TO RELATED APPLICATION

The present application is a continuation of U.S. patent application Ser. No. 11/146,654, filed on Jun. 6, 2005 now abandoned, which is expressly incorporated herein in its entirety by reference thereto.

FIELD OF THE INVENTION

The present invention generally regards packages and containers. More particularly, the present invention regards a method and device for providing a composite two-piece tamper-evident closure with a seal-delay-release feature.

BACKGROUND INFORMATION

Tamper evident seal may be used to increase consumer safety by showing whether a package has been opened after being produced. Tamper evident indicators may include a pop-up button in the center of a package and a break-away seal connected to the lower edge of a lid. The pop-up button has the disadvantage that it may be difficult to ascertain whether the seal has been broken. The break-away lower lid section may be too sensitive and may break away inadvertently during normal jostling. Alternatively, the break-away lower lid section may be insensitive to tampering or pilfering, and may not break away until after the seal between the closure and the container has been breached. The latter situation raises the possibility that the container may be accessed and resealed without breaking the tamper evident seal. This possibility undermines the purpose behind the tamper evident seal, thereby reducing consumer confidence in a product sealed in this manner.

The following patents are believed discuss tamper evident seals. U.S. Pat. No. 3,306,482 is believed to describes a safety closure for containers including first and second relatively rotatable and axially movable members, and engageable and disengageable clutch means which are operable respectively to disable and enable relative rotation of the members.

U.S. Pat. No. 3,438,528 is believed to describe a cap having a tamper indicating skirt joined to the lower end of the cap sidewall by frangible bridges of plastic and a sealing disc which seals against the rim of the bottle neck.

U.S. Pat. No. 4,807,770 is believed to describe a tamper evident, vacuum indicating closure for a container for the packaging of a vacuum-packed product. The closure is of two-piece construction and has a metal lid portion which is retained in sealing engagement with the rim of a container by a plastic ring portion.

U.S. Pat. No. 5,031,787 is believed to describe a closure having an axially movable insert disk which is lifted by a bead around the inside of the closure shell to open a sealed container.

U.S. Pat. No. 5,884,788 is believed to describe a tamper-indicating closure for a container which includes a cap with removable panels of a top wall of the cap. Each removable panel is connected to a tab on the inside of the cap. The top wall includes inner and outer cams on an inside surface and the tabs underlie the cams.

U.S. Pat. No. 5,984,124 is believed to describe a pilfer-proof cap made of synthetic resins capable of preventing at least a rotation of a packing together with a cap in a simple construction when the cap is removed. The cap holds a sealed-up tightness of a container until a bridge is broken is provided.

U.S. Pat. No. 6,382,444 is believed to describe a tamper evident closure for containers having a finish with thread means and a radially outwardly circumferentially extending bead below the threads. The closure includes a cap portion, a retainer ring, and a tamper evident band. The cap portion is of cup-like form and has internal threads for cooperatively engaging the threads on a container to apply and remove the cap portion. The retainer ring depends from the lower edge of the skirt portion of the cap and is connected thereto by a series of circumferentially spaced bridge connections. The tamper evident band has means for rotatably mounting on the retaining ring, is rotatable thereto, and includes a series of spring fingers for engaging under the retainer bead on the container when the closure is fully seated.

U.S. Patent Application Publication No. 2002/0144971 is believed to describe a closure for a container consisting of a top wall and a sealing disc with flexible annular ring.

However, none of the foregoing patents or publications is believed to describe a two-piece, tamper-evident closure that includes a delay-release mechanism, which may maintain a sealing disk on a container until the tamper-evident device shows evidence of tampering.

SUMMARY

In accordance with an example embodiment of the present invention, an outer threaded tamper-evident closure is provided with an open center top panel, engaging axially extended lugs and a sealing disk pressure ring. An inner sealing disk is provided with axially extended lugs, a peripheral beveled lip and a container sealing area. The two-piece assembly provides a tamper-evident closure with a delay-release feature that maintains the sealing disk on the container until the tamper-evident device has shown evidence of tampering. The delay-release feature includes axially extended lugs of the outer closure and the sealing disk that cooperates as positive-on application lugs and sealing release lugs. The timing of the delay-release mechanism depends on the helix angle of the outer closure thread design and the inclined plane of the inner sealing disk lug. The angle of the inclined plane of the inner sealing disk lug may be greater than or equal to the helix angle of the outer closure thread. The inclined plane of the sealing disk lug may also reduce the backing-off of the threaded closure and releasing its seal upon the container. The freedom of the inner sealing disk to rotate within the threaded closure may permit the engagement of the cooperating lugs for a positive-on application on the container.

An apparatus according to an example embodiment of the present invention may include an outer closure including a closure plane and a circumferentially depending outer skirt extending in a first direction from the closure plane. The closure plane has a plurality of first ramped lugs equi-spaced around a circumference of the closure plane. The first ramped lugs extend axially in the first direction. The outer skirt has screw threads on a radially inward side and a tamper-evident arrangement frangibly connected to a lower edge of the outer skirt. A first ramp of each of the first ramped lugs is substantially parallel to the screw threads on a same radius. The apparatus also includes an inner sealing disk adapted to nest rotatably and axially movably against a side of the closure plane facing the first direction. The inner sealing disk is enclosed by the outer skirt and an axial movement of the inner sealing disk is limited by a retaining arrangement of the outer closure. The inner sealing disk includes a plurality of second ramped lugs extending axially in a second direction opposite the first direction. Each of the second ramped lugs corresponds to one of the first ramped lugs. A second ramp of each of the second ramped lugs is substantially parallel to the first ramp for each radial position.

In accordance with an example embodiment of the present invention, a container includes a sidewall having further screw threads on a radially outward side adapted to engage the screw threads on the outer closure and an upper edge adapted to engage a container sealing area of the inner sealing disk. The upper edge is arranged around an opening of the container. The sidewall has an arrangement adapted to engage the tamper-evident arrangement of the outer closure. The container also includes a base opposite the opening.

The outer closure and the inner sealing disk cooperate to provide a tamper-evident closure with the container. The tamper-evident closure maintains the inner sealing disk on the container while the outer closure is unthreaded from the container for a first time until the tamper-evident arrangement shows evidence of tampering.

The outer closure and the inner sealing disk may cooperate to provide a delay-release mechanism. The delay-release feature may include the plurality of first ramped lugs and the plurality of second ramped lugs. A timing of the delay-release mechanism may be a function of a helix angle of the further screw threads and an inclined plane of the second ramp. The angle of the inclined plane may be greater than or equal to the helix angle. The container sealing area may be arranged around a radially outward edge of the inner sealing disk. The container sealing area may include a peripheral beveled lip arranged on an outer circumference of the inner sealing disk. The peripheral beveled lip may be adapted to engage the upper edge of the sidewall of the container. A mutual engagement between each of the first ramped lugs and a corresponding one of the second ramped lugs may delay a releasing of a seal between the inner sealing disk and the container when the outer closure is unthreaded from the container. A rotatability of the inner sealing disk within the threaded closure may permit a mutual engagement of the plurality of first ramped lugs and the plurality of second ramped lugs, the mutual engagement being configured to cause a positive-on application on the container. The closure plane may include an annular opening.

In accordance with an example embodiment of the present invention, a method is for sealing a closure on a container in a tamper-evident manner. The method includes providing an outer closure, providing an inner sealing disk, and providing a container. The method also includes tightening the outer closure onto the container until the container sealing area contacts the upper edge of the container and the tamper evident arrangement engages an arrangement adapted to engage the tamper-evident arrangement.

DETAILED DESCRIPTION

Figure 1:
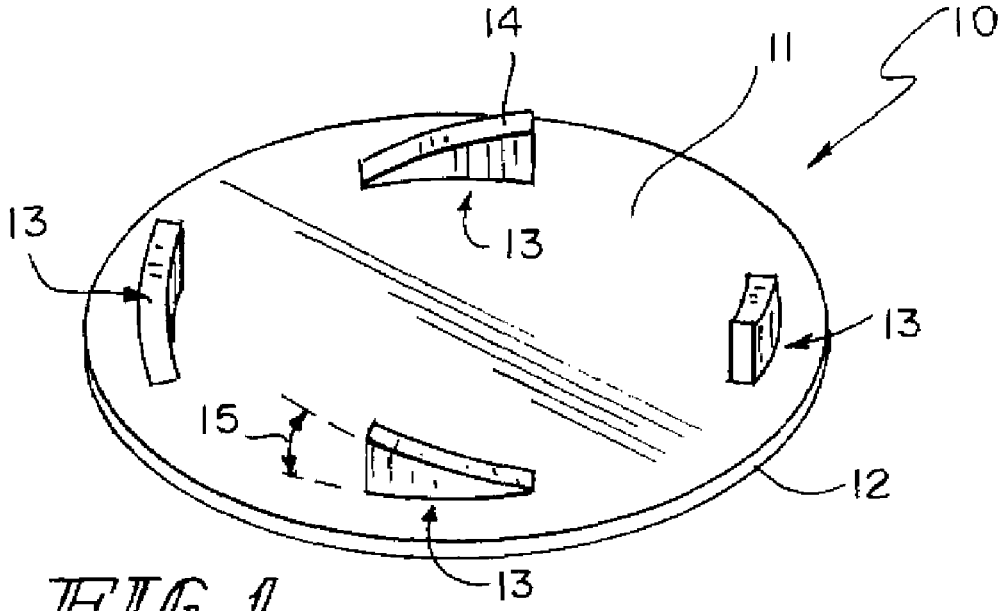
FIG. 1 shows an inner sealing disk according to an exemplary embodiment of the present invention.

FIG. 1 shows inner sealing disk 10 having closure surface 11 and sealing area 12 arranged around a circumference of closure surface 11. Four equi-spaced ramped lugs 13 are shown as being arranged around the circumference of closure surface 11, although it should be understood that more or fewer lugs may be provided. Each of ramped lugs 13 includes ramp 14 which are all arranged in the same angle. In other words, traveling around the circumference in one direction (e.g., clockwise), each successive ramped lug 13 is encountered with the same orientation. For example, traveling clockwise around the circumference in the exemplary embodiment shown in FIG. 1, each ramped lug 13 is encountered at the beginning of the ramp, then rising up to the top of the ramp, then dropping off to the closure plane, and then proceeding to the next successive ramped lug 13. An angle 15 is provided at each ramped lug 13 between ramp 14 and closure surface 11. Each angle 15 for each ramped lug 13 is substantially equal to each other angle 15.

Figure 2:
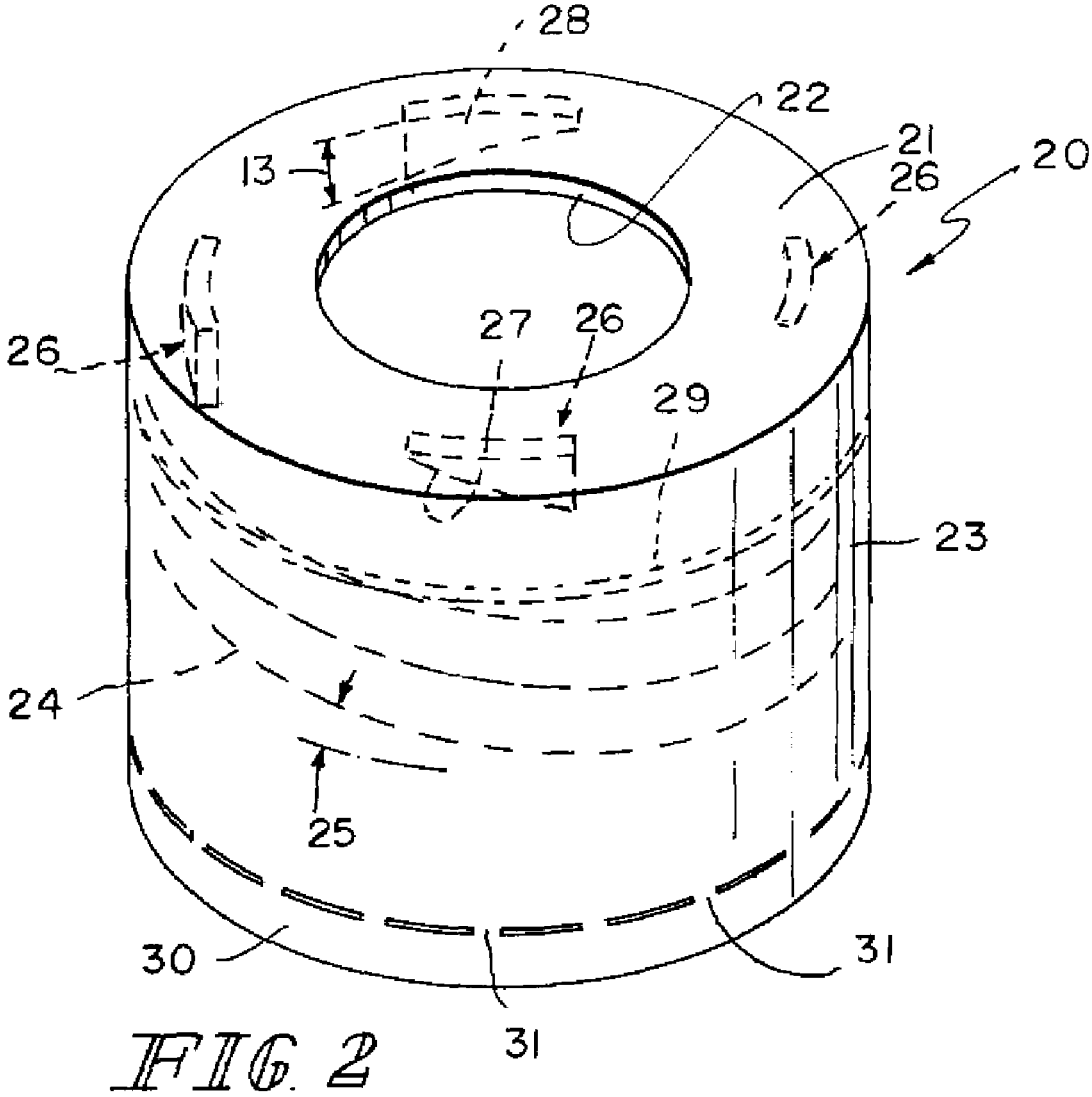
FIG. 2 shows an outer closure according to an exemplary embodiment of the present invention.

FIG. 2 shows outer closure 20 having closure plane 21 and outer skirt 23. Closure plane 21 includes annular opening 22 positioned centrally in closure plane 21 and symmetrical around an axis of closure plane 21. On an inner sidewall of outer skirt 23 are arranged screw threads 24. Screw threads 24 form angle 25 between an inclined plane passing through screw threads 24 and a plane parallel to closure plane 21. Arranged around the circumference of closure plane 21 are additional ramped lugs 26. Additional ramped lugs 26 are positioned to cooperate with inner sealing disk 10 when inner sealing disk 10 is nested in outer skirt 20. Additional ramped lugs 26 include additional ramps 27. Additional ramps 27 form angle 28 with closure plane 21. Angle 28 may be substantially greater than or equal to angle 25. Locking bead 29 is arranged on the interior of outer skirt 23 and defines a diameter smaller than the diameter of inner sealing disk 10. Therefore, inner sealing disk 10 can be arranged between closure plane 21 and locking bead 29 to nest inner sealing disk 10 in outer closure 20. When nested in closure 20, inner sealing disk 10 is rotatable and movable axially. On the edge of outer skirt 23 away from closure plane 21 is tamper evident breakable ring 30. Tamper evident breakable ring 30 is connected to outer skirt 23 by frangible connectors 31, which may consist of a plurality of equi-spaced bridges between tamper evident breakable ring 30 and outer skirt 23, and which may be scored to facilitate breaking.

Figure 3:
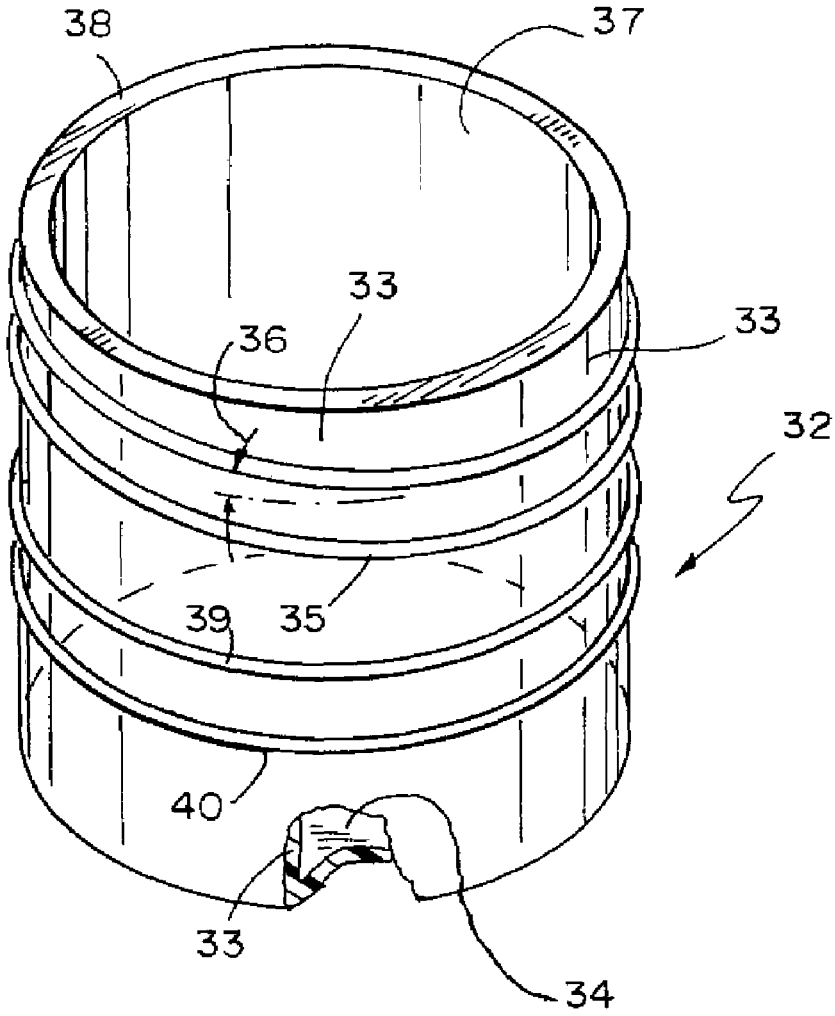
FIG. 3 shows a container according to an exemplary embodiment of the present invention which is configured to engage with the inner sealing disk illustrated in FIG. 1 and the outer closure illustrated in FIG. 2.

FIG. 3 shows container 32 having sidewall 33 and base 34. Container screw threads 35 are arranged around an exterior of sidewall 33 and form an angle 36 between the inclined plane of container screw threads 35 and a plane parallel to base 34. Angle 36 is substantially equal to angle 25 of outer skirt 20. Opposite base 34 is opening 37, which is defined by upper edge 38 of sidewall 33 of container 32. Continuous bead 39 is arranged below container screw threads 35 and is configured to cooperate with tamper evident breakable ring 30. Keeper bead 40 is arranged below continuous bead 39 and may or may not be a continuous bead around container 32.

Figure 4:
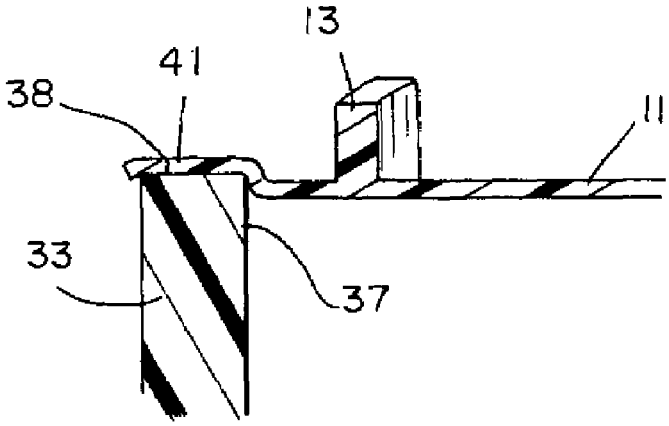
FIG. 4 shows a cross-sectional view of an inner sealing disk and a container according to an exemplary embodiment of the present invention.

FIG. 4 shows a close-up, cross-sectional view of the seal between inner sealing disk 10 and container 32. Closure surface 11 has ramped lug 13 near a circumference of closure surface 11. Beveled edge 41 fits over upper edge 38 to form a seal of the interior of container 32 over opening 37.

Figure 6:
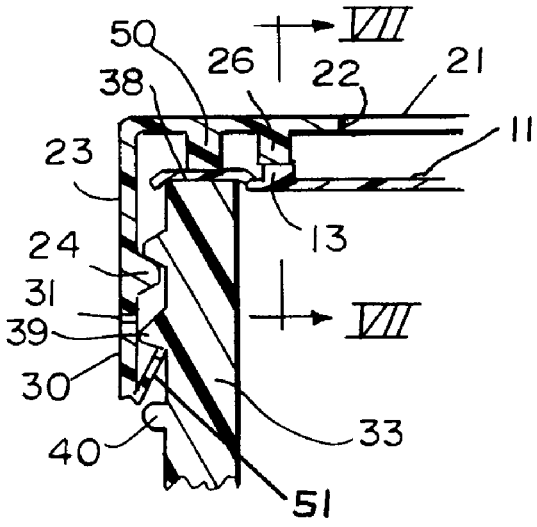
FIG. 6 shows a cross-sectional view of the outer closure shown in FIG. 5 taken along the line VI-VI, the outer closure engaging with an inner sealing disk and a container according to an exemplary embodiment of the present invention.

Operation of the closure including outer closure 20 and inner sealing disk 10 with container 32 is described in the following. Inner sealing disk 10 is nested within outer closure 20 between locking bead 29 and closure plane 21. Each ramped lug 13 is arranged adjacent to a corresponding additional ramped lug 26 so that each ramp 14 of each ramped lug 13 rests against a corresponding additional ramp 27. Screw threads 24 of outer closure 20 are threaded onto container-screw threads 35 with sufficient tightness to cause beveled edge 41 to form an airtight seal with upper edge 38 of container 32. The closure is sealed on container 32 in this manner during production, thereby securing the contents of container 32. A tamper evident indicator includes tamper evident breakable ring 30 on outer skirt 23 of outer closure 20. The tamper evident breakable ring 30 surrounds container 32 below continuous bead element 39. Tamper evident breakable ring 30 includes an engaging member (for example, lower lip member 51 shown in FIG. 6) which, though allowing the passage of tamper evident breakable ring 30 over continuous bead element 39 in a closing direction, does not allow the passage of tamper evident breakable ring 30 over continuous bead element 39 in an opening direction. Continuous bead element 39 is adapted to engage member 51 of the tamper-evident indicator when outer closure 20 is rotated in a closing direction to thread the closure 20 onto the container 32 as shown in FIG. 6. When outer closure 20 is rotated for removal (for example, in a clockwise direction in the exemplary embodiment shown in the figures), the engaging arrangement of tamper evident breakable ring 30 contacts continuous bead element 39. Continuing rotation of outer closure 20 continues to unthread outer closure 20 and to cause the breaking of frangible connectors 31. When frangible connectors 31 are all broken, tamper evident breakable ring 30 is disconnected from outer skirt 23 of outer closure 20. Tamper evident breakable ring 30 is held around container 32 between continuous bead element 39 and keeper bead 40 and functions as an indicator that container 32 has been opened and may no longer be in an unadulterated condition.

Inner sealing disk 10 operates with outer closure 20 to maintain a seal with container 32 until all frangible connectors 31 have broken and tamper evident breakable ring 30 is disconnected from outer skirt 23. Therefore, inner sealing disk 10 may cooperate with outer closure 20 to maintain a downward pressure against upper edge 38 of sidewall 33 of container 32 even as outer closure 20 is rising away from upper edge 38. This downward force on inner sealing disk 10 is caused by the mutual action of ramped lug 13 and additional ramped lug 26. Specifically, each ramp 14 of each ramped lug 13 rests against a corresponding additional ramp 27 of additional ramped lug 26. Rotating outer closure 20 to unscrew screw threads 24 from container screw threads 35 causes ramp 14 to engage additional ramp 27 in an increasing fashion as the ramps slide against each other towards their respective highest points. This opposing force caused by the mutual interaction between ramps 14 and additional ramps 27 presses inner sealing disk 10 down towards container 32 and thereby maintains the airtight seal of container 32 as outer closure 20 rises. Therefore, the rising of outer closure 20 will cause the breaking of frangible connectors 31 prior to losing the seal. In this manner, tamper evident breakable ring 30 will reliably indicate that the seal of container 32 has been breached.

Figure 5:
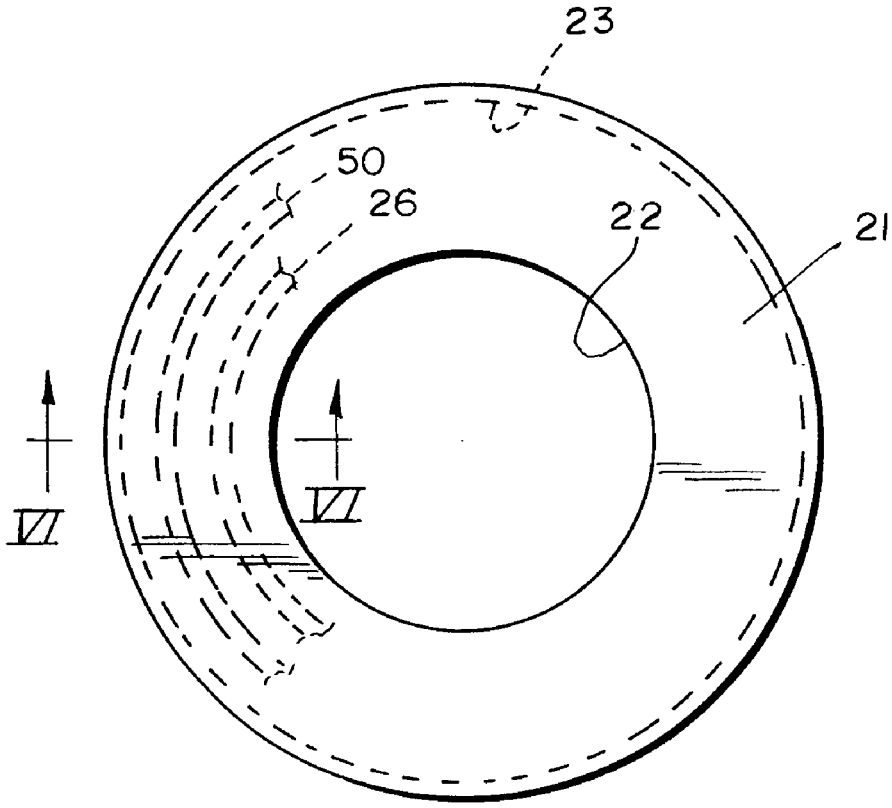
FIG. 5 shows a plan view of an outer closure according to an exemplary embodiment of the present invention.

FIG. 5 shows a plan view of outer closure 20 including closure plane 21 and annular opening 22. Additional ramped lugs 26 are shown in silhouette through a portion of closure plane 21 and are arranged in this exemplary embodiment on an inside circumference of closure plane 21, adjacent to annular opening 22. Alternative positions for additional ramped lugs 26 on a larger circumference are also possible. Alternatively, annular opening 22 may be smaller or non-existent and additional ramped lugs 26 may be on a smaller circumference. FIG. 5 shows a silhouette of outer skirt 23 on an outside circumference of closure plane 21. FIG. 5 also shows a silhouette of sealing lug 50, which is arranged on a circumference between additional ramped lugs 26 and outer skirt 23. Sealing lug 50 may press on inner sealing disk 10 to create an airtight seal with container 32 when outer closure 20 is in a tight, sealed position.

FIG. 6 shows a cross-sectional view taken along line VI-VI of FIG. 5. FIG. 6 shows outer closure 20 in a tight, sealed position on inner sealing disk 10 which is on container 32. Outer closure 20 includes closure plane 21 and annular opening 22. Additional ramped lugs 26 and sealing lug 50 are shown in FIG. 6 from an edge on perspective. Outer skirt 23 having screw threads 24 is also visible. On the lower edge of outer skirt 23 is tamper evident breakable ring 30, which is attached to outer skirt 23 by frangible connectors 31. Since frangible connectors 32 are still connected to outer skirt 23, container 32 is in an unadulterated state. Since tamper evident breakable ring 30 is attached to outer skirt 23, a user may be assured that the contents of container 32 have not been contaminated or pilfered by removal of inner sealing disk 10. Unscrewing outer closure 20 from container 32 by sliding screw thread 24 adjacent to container screw threads 35 causes outer closure 20 to move away from sidewall 33. As outer skirt 23 moves up, tamper evident breakable ring 30 engages continuous bead 39 causing frangible connectors 31 to break, disconnecting tamper evident breakable ring 30 from outer skirt 23. Tamper evident breakable ring 30 falls when disconnected from outer skirt 23 and is held on container 32 between continuous bead 39 and keeper bead 40. When tamper evident breakable ring 30 is disconnected, a user is provided with a visual indication that the container has been tampered with. Inner sealing disk 10 is held against upper edge 38 of sidewall 33 by sealing lug 50 of outer closure 20 pressing downwards on closure surface 11 opposite upper edge 38. Also pressing downwards on closure surface 11 is the mutual engagement of ramped lugs 13 and additional ramped lugs 26. The mutual engagement of of ramped lugs 13 and additional ramped lugs 26 continues and may even increase when outer closure 20 is rotated and therefore moves up away from sidewall 33. The continuing downward pressure caused by the mutual engagement of ramped lugs 13 and additional ramped lugs 26 maintains the seal between inner sealing disk 10 and upper edge 38 at least until frangible connectors 31 of tamper evident breakable ring 30 are broken. Therefore, the seal between inner sealing disk 10 and container 32 is maintained until the visual indicator of the separated tamper evident breakable ring 30 communicates to a user that the seal has been broken.

The tamper evident breakable ring 30 may include features similar to features included in the device described in U.S. Pat. No. 6,371,317, which is expressly incorporated herein in its entirety by reference thereto. For example, the tamper evident breakable ring 30 may include, for example, the tabs described in U.S. Pat. No. 6,371,317.

Figure 7:
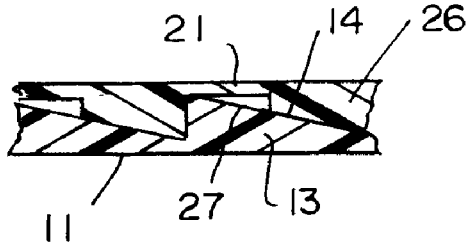
FIG. 7 shows a cross-sectional view of the outer closure and the inner sealing disk shown in FIG. 6 taken along the line VII-VII.

FIG. 7 shows a cross-sectional view of the exemplary embodiment of the apparatus shown in FIG. 6 taken along the line VII-VII. FIG. 7 shows closure plane 21 arranged on top of closure surface 11. Ramped lug 13 is shown having ramp 14, which rests against corresponding additional ramp 27 of additional ramped lug 26. Rotation of the outer closure in an "off" direction causes closure plane 21 to move to the left relative to closure surface 11. This movement causes the engagement of ramp 14 and corresponding additional ramp 27 to counteract the movement upwards for closure plane 21. This causes the closure surface to maintain the vertical position and to thereby maintain a seal on the container.

What is claimed is:

1. An apparatus, comprising:

an outer closure including a closure plane and a circumferentially depending outer skirt extending in a first direction from the closure plane, the closure plane having a plurality of first ramped lugs equi-spaced around a circumference of the closure plane, the first ramped lugs extending axially in the first direction, the outer skirt having screw threads on a radially inward side and a tamper-evident arrangement frangibly connected to a lower edge of the outer skirt, and an inner sealing disk adapted to nest against a side of the closure plane facing the first direction, the inner sealing disk encloseable by the outer skirt, the inner sealing disk including a plurality of second ramped lugs extending axially in a second direction opposite the first direction, each of the second ramped lugs corresponding to a respective one of the first ramped lugs, a second ramp of each of the second ramped lugs substantially parallel to the first ramp for each radial position.

2. The apparatus of claim 1, further comprising a container including:

a sidewall having screw threads on a radially outward side adapted to engage the screw threads on the outer closure and an upper edge adapted to engage a container sealing area of the inner sealing disk, the upper edge arranged around an opening of the container, the sidewall having an arrangement adapted to engage the tamper-evident arrangement of the outer closure; and a base opposite the opening.

3. The apparatus of claim 2, wherein the outer closure and the inner sealing disk are configured to provide a tamper-evident closure with the container, the tamper-evident closure configured to maintain the inner sealing disk on the container during an unthreading of the outer closure from the container for a first time until the tamper-evident arrangement indicates tampering.

4. The apparatus of claim 3, wherein the outer closure and the inner sealing disk are configured to provide a delay-release mechanism.

5. The apparatus of claim 4, wherein the delay-release mechanism includes the plurality of first ramped lugs and the plurality of second ramped lugs.

6. The apparatus of claim 4, wherein a timing of the delay-release mechanism is a function of a helix angle of the screw threads and an inclined plane of the second ramp.

7. The apparatus of claim 6, wherein an angle of the inclined plane is greater than or equal to the helix angle.

8. The apparatus of claim 2, wherein the container sealing area is arranged around a radially outward edge of the inner sealing disk.

9. The apparatus of claim 8, wherein the container sealing area includes a peripheral beveled lip arranged on an outer circumference of the inner sealing disk, the peripheral beveled lip adapted to engage the upper edge of the sidewall of the container.

10. The apparatus of claim 2, wherein the container includes a keeper arrangement adapted to maintain the tamper-evident arrangement on the container after the frangible connection between the tamper-evident arrangement and the lower edge of the outer skirt has been broken.

11. The apparatus of claim 2, wherein a mutual engagement between each of the first ramped lugs and a corresponding one of the second ramped lugs delays release of a seal between the inner sealing disk and the container during an unthreading operation of the outer closure from the container.

12. The apparatus of claim 1, wherein rotation of the inner sealing disk within the threaded closure is configured to mutually engage the first ramped lugs and the second ramped lugs.

13. The apparatus of claim 1, wherein the closure plane includes an annular opening.

14. A system, comprising:

an outer closure including a closure plane and a circumferentially depending outer skirt extending in a first direction from the closure plane, the closure plane having a plurality of first ramped lugs equi-spaced around a circumference of the closure plane and extending axially in the first direction, the outer skirt having screw threads on a radially inward side and a tamper-evident indicator frangibly connected to a lower edge of the outer skirt;

an inner sealing disk adapted to nest against a side of the closure plane facing the first direction, the inner sealing disk encloseable by the outer skirt, the inner sealing disk including a plurality of second ramped lugs extending axially in a second direction opposite the first direction, each of the second ramped lugs corresponding to a respective one of the first ramped lugs, a second ramp of each of the second ramped lugs substantially parallel to the first ramp for each radial position; and a container a sidewall having screw threads on a radially outward side adapted to engage the screw threads on the outer closure and an upper edge adapted to engage a container sealing area of the inner sealing disk, the upper edge arranged around an opening of the container, the sidewall having an arrangement adapted to engage the tamper-evident indicator of the outer closure and a base opposite the opening.

15. A method for sealing a closure device on a container in a tamper-evident manner, the closure device including an outer closure and an inner sealing disk, the outer closure including a closure plane and a circumferentially depending outer skirt extending in a first direction from the closure plane, the closure plane having a plurality of first ramped lugs equi-spaced around a circumference of the closure plane and extending axially in the first direction, the outer skirt having screw threads on a radially inward side and a tamper-evident indicator frangibly connected to a lower edge of the outer skirt, the inner sealing disk nested against a side of the closure plane facing the first direction, the inner sealing disk enclosed by the outer skirt, the inner sealing disk including a plurality of second ramped lugs extending axially in a second direction opposite the first direction, each of the second ramped lugs corresponding to a respective one of the first ramped lugs, a second ramp of each of the second ramped lugs substantially parallel to the first ramp for each radial position, the container including a sidewall having screw threads on a radially outward side adapted to engage the screw threads on the outer closure and an upper edge adapted to engage a container sealing area of the inner sealing disk, the upper edge arranged around an opening of the container, the sidewall having an element adapted to engage a member of the tamper-evident indicator of the outer closure and a base opposite the opening, comprising:

tightening the outer closure onto the container until the container sealing area contacts the upper edge of the container and the member of the tamper evident indicator engages the element.

16. An apparatus, comprising:

an outer closure including a closure plane and a circumferentially depending outer skirt extending in a first direction from the closure plane, the closure plane having a plurality of first ramped lugs substantially equally spaced around the closure plane, the first ramped lugs extending axially in the first direction, the outer skirt having screw threads on a radially inward side and a tamper-evident indicator frangibly connected to a lower edge of the outer skirt; and an inner sealing disk adapted to nest against a side of the closure plane facing the first direction and against an upper edge of the opening of a container, the inner sealing disk encloseable by the outer skirt, the inner sealing disk including a plurality of second ramped lugs extending axially in a second direction opposite the first direction, each of the second ramped lugs corresponding to a respective one of the first ramped lugs, a second ramp of each of the second ramped lugs substantially parallel to the first ramp for each radial position whereby the plurality of first ramped lugs and the plurality of second ramped lugs are adapted to maintain the seal between the inner sealing disk and the upper edge of the opening of the container during removal of the outer closure from the container at least until the tamper-evident indicator is frangibly disconnected from the lower edge of the outer skirt.

17. The apparatus of claim 16, wherein the plurality of first ramped lugs and the plurality of second ramped lugs are shaped so that during removal of the outer closure from the container the plurality of first ramped lugs move with respect to the plurality of second ramped lugs at least until the tamper-evident indicator is frangibly disconnected from the lower edge of the outer skirt.

* * * * *